US006580391B1

(12) United States Patent
Kepley et al.

(10) Patent No.: US 6,580,391 B1
(45) Date of Patent: Jun. 17, 2003

(54) ANTENNA ALIGNMENT SYSTEM AND METHOD

(75) Inventors: Walter Kepley, Gaithersburg, MD (US); Paul Gaske, Rockville, MD (US); Michael Middeke, Jefferson, MD (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/976,230

(22) Filed: Oct. 12, 2001

(51) Int. Cl.[7] ..... H01Q 3/00
(52) U.S. Cl. ..... 342/359; 342/362; 342/363
(58) Field of Search ..... 342/359, 430, 342/361, 362, 363, 364, 365, 366; 343/763, 766

(56) References Cited

U.S. PATENT DOCUMENTS 5,434,586 A * 7/1995 Kinoshita et al. ..... 343/840
5,812,096 A * 9/1998 Tilford ..... 343/781 R

* cited by examiner

*Primary Examiner*—Theodore M. Blum
(74) *Attorney, Agent, or Firm*—John T. Whelan; Michael Sales

(57) ABSTRACT

An antenna alignment apparatus and alignment method is used to effectively position an antenna used in a satellite communication system on the satellite orbital arc, and to ensure that a proper antenna polarization is achieved during installation or alignment of a remote station antenna. The apparatus includes a secondary receiving device mounted on the feed arm of the antenna at a specified distance from the primary receiving device located on the primary plane of the antenna. An antenna using this system and method may be properly aligned on the orbital arc using only simple receiving equipment.

25 Claims, 8 Drawing Sheets

SATELLITE ANTENNA POINTING APPARATUS

SATELLITE ANTENNA POINTING APPARATUS

SATELLITE ANTENNA POINTING APPARATUS

LEG ATTACHMENT

LEG ATTACHMENT

REPRESENTATIVE RECEIVING DEVICE

SATELLITE COMMUNICATION SYSTEM

OFFSET-FEED GAIN VS. BORESIGHT ANGLE

IMPROVED SATELLITE ANTENNA ALIGNMENT PROCESS

CONVENTIONAL SATELLITE ANTENNA ALIGNMENT PROCESS

ANTENNA ALIGNMENT SYSTEM AND METHOD

BACKGROUND OF THE INVENTION

1. Field of the Invention

This invention relates generally to an antenna pointing apparatus and method used in connection with aligning radio-frequency (RF) emissions from an antenna, and further relates to improving antenna performance in a satellite communication system using only relatively simple equipment.

2. Description of the Related Art

Typically, an installer desires to maximize or optimize, to the extent possible, a satellite earth station's performance, including the performance of the antenna which propagates/receives radio-frequency energy to/from one or more satellites. Determining whether the earth station's antenna's performance is optimized as much as possible under the particular circumstances is not always a simple matter. Several steps must be accomplished in making that determination. These include, but are not limited to, for example, aligning the earth station antenna in azimuth and elevation so that the antenna "boresight" is pointing directly at a particular satellite of interest, and also adjusting the polarization orientation of the earth station's antenna so that a cross-polarization isolation parameter measured at a hub station, for example, is acceptable for discriminating between signals having a different polarization than the polarization of a desired signal.

Other antenna parameters which may be of interest to installers and operators include gain, noise temperature, voltage standing-wave ratio (VSWR), power rating, receive-transmit group delay, radiation pattern, isolation, and so-called "G/T", or antenna gain divided by system noise temperature. Many of these parameters are inherent in the fundamental antenna design, while others, such as cross-polarization isolation, may be adjusted to a specified value using an alignment procedure during antenna installation The case of alignment of an earth station's antenna to a geostationary satellite is a simplified version of the general case of tracking a satellite in a non-geo-synchronous orbit. There are typically two angles of interest between the earth station and the satellite: the elevation angle, and the azimuth angle. The elevation angle is the angle of the satellite above the horizon, as measured from the earth station, and the azimuth is the angle between the line of longitude through the earth station, and the direction of a sub-satellite point, i.e. the point at which a line between the satellite and the center of the earth intersects the earth's surface. The angle of elevation depends on the latitude of the earth station, and will be relatively large towards the equator, and smaller toward the poles, while the azimuth angle is related to the latitude and longitude of the earth station. Thus, the elevation and azimuth angles define the "boresight" of the receiving antenna for a given receiver location, with respect to a particular geostationary satellite's orbital position.

Conventionally, in order to measure and/or adjust the cross-polarization isolation of an antenna at an earth station, or "remote station", an installer must first align the antenna boresight to the specific satellite being used. This may be accomplished, for example, by merely roughly setting the azimuth and elevation angles based on a tabulation of angles corresponding to the satellite of interest, as a function of the latitude and longitude of the remote station. For more precise alignment, however, these settings could be used as an initial setting, and then a signal transmitted from the satellite could be monitored, and the azimuth and elevation angles could be more precisely adjusted based on "peaking" or maximizing the received signal, or simply by ensuring that the received signal is greater than a desired threshold signal value. Typically, the maximum signal strength achievable is used in finally adjusting the azimuth and elevation of the remote station antenna to ensure that the boresight of the remote earth station is accurately aligned with the satellite.

After the azimuth and elevation angles of the remote station antenna are set, the person installing the antenna would activate the transmitter at the remote station to uplink to the satellite, and the satellite would then, in turn, downlink to the hub station or network operations center. Typical communication satellites may have multiple transponders that receive signals at one frequency from one or more remote stations, and then retransmit these signals at a different offset frequency to the hub. Further, each of these transponders may be configured to receive a signal having a particular type of polarization, e.g. a polarization type that is one of the general cases of linear, circular, or elliptical polarization. More specifically, the satellite transponders may receive horizontal or vertical linear polarization, or right-hand or left-hand circular polarization. Further, the satellite transponders may retransmit to the hub using a different type of polarization than the type originally received from the remote station. For example, in the case of linear polarization, a transponder may receive a horizontally polarized signal from a remote earth station, and may retransmit a vertically polarized signal to the hub station. This same type of transponder approach may be used in the reverse direction, i.e., in transmitting from the hub to one or more remote stations through the satellite and appropriate transponders.

Therefore, it is not enough to merely align the boresight of the remote station antenna to the satellite of interest. The remote station must also account for and align to the polarization type that the satellite transponder is configured to receive and/or retransmit. If the polarization of the remote station antenna is not properly aligned to the satellite transponder's polarization (e.g. horizontal or vertical linear polarization), or is of the incorrect type, a reduction in signal strength most likely will occur at both the remote station and at the hub. In addition, cross-polarization interference may also occur between adjacent satellite transponders configured, in an interleaved fashion, to receive signals from other remote stations in the same frequency band, but with different polarizations, if the remote station is transmitting a signal with an undesired polarization. This interference will also then be received at the hub.

To preclude such cross-polarization induced interference problems, cross-polarization isolation may be determined at the hub by measuring, for example in the case of linear polarization, the signal strength of the desired linearly polarized signal being transmitted from one transponder on the satellite, and the signal strength of the undesired linearly polarized signal which is transmitted from an adjacent transponder on the satellite. The undesired linearly polarized signal is retransmitted by the transponder primarily due to misalignment of the remote station antenna polarization. If the remote antenna polarization is properly aligned, the undesired linearly polarized signal should theoretically be eliminated. Practically speaking, however, the undesired linearly polarized signal should be at least reduced by a typical value of at least−30 dB (1/1000th) from the signal strength of the desired linearly polarized signal, as measured at the hub. To be able to actually meet this typical value of isolation, the polarization at the remote station is usually iteratively adjusted until the cross-polarization isolation is within the specified value.

Unfortunately, this procedure requires that fine adjustments in the remote station antenna alignment must continue to be made until cross-polarization isolation, is at the desired or best-achievable value under the circumstances. Such a procedure necessarily requires dedicated communication (e.g. by telephone) between the installer at the remote station and hub station personnel. This process, as represented by the flow-chart of FIG. 6, takes time, satellite resources, and hub site resources, possibly resulting in interruption of service, and, most likely, increased installation and operating costs.

A more reliable approach from a time and satellite resource viewpoint would be to greatly simplify this process. However, the known approaches to solving the problem of antenna alignment does not make use of simplified devices and procedures, and instead merely relies upon the "brute force" method of aligning the antenna which requires use of satellite and technical personnel resources to accommodate a downlink from the satellite to the hub to measure the desired parameter, e.g. cross-polarization, as discussed above.

What is needed, therefore, is a relatively low-cost, inexpensive, and reliable apparatus and method using simple equipment for simplifying antenna alignment, and improving system performance.

SUMMARY OF THE INVENTION

The present invention solves at least one of the aforementioned problems of establishing acceptable antenna alignment during system installation at a remote station, including antenna polarization alignment, which thereby achieves a desired cross-polarization isolation at a hub site, and which reduces the costs associated with installation time and use of satellite and hub station resources required for the installation at the remote station.

A first aspect of the present invention embodies an apparatus for aligning an antenna which includes a secondary receiving device arranged on the antenna and separated from a primary receiving device of the antenna by a particular offset distance, wherein the primary receiving device receives a first signal and the secondary receiving device receives a second signal, and wherein alignment of the antenna is made by pointing the secondary receiving device in a direction of the second signal.

In this aspect of the invention, the antenna is preferably aligned in azimuth and elevation to the desired satellite using a signal received by the primary receiving device along the antenna boresight. The proper antenna polarization with respect to the first signal may first be adjusted by aligning the secondary receiving device mounted on the antenna using a second signal transmitted by a second satellite adjacent to the desired satellite. The secondary receiving device then preferably receives the second signal at a scan angle offset from the antenna boresight, wherein the offset scan angle is determined, at least in part, by the particular offset distance of the secondary receiving device from the primary receiving device. In addition, the particular offset distance may be a variable offset distance which is adjustable by the installing technician, so that a variety of satellites adjacent to the primary or desired satellite may function as the second or adjacent satellite, depending on the variable offset distance chosen.

A second aspect of this invention is directed to a method of aligning an antenna, which preferably includes the steps of monitoring a received signal strength of a primary signal; adjusting a position of the antenna based on the received signal strength of the primary signal; monitoring a received signal strength of a secondary signal; and further adjusting the antenna based on the received signal strength of the secondary signal.

In this aspect of the invention, the polarization angle of the antenna may be brought into the proper alignment with respect to the desired satellite transmission by further aligning the antenna to "peak" or substantially maximize the signal strength of the secondary signal received from a satellite adjacent to the desired satellite. In this method, a secondary receiving device is arranged in a position separated from a primary receiving device in such a manner that a rotational position of the antenna about its boresight axis aligns the primary receiving device along the boresight axis with the desired satellite, and also aligns the secondary receiving device with an adjacent satellite offset from the boresight by an offset angle. By using such an alignment method, the use of dedicated hub resources (personnel, equipment, and bandwidth) is not necessary, and the antenna polarization with respect to the desired satellite may easily be set using only simple test equipment and procedures.

The present invention has a number of features that distinguish it over conventional antenna alignment approaches that attempt to determine the proper polarization alignment by monitoring the signal levels of cross-polarized signals transmitted from the remote station to the hub through satellite transponders. For example, the method and system of the present invention uses simple and relatively inexpensive approach to remote station satellite antenna alignment, whereas conventional approaches to solving this problem have relied only upon the "brute force" method which requires extensive communication and coordination between the remote station and the hub, and which unnecessarily requires the use of channel bandwidth and technical personnel resources to align the remote station antenna after installation.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent from this detailed description to those skilled in the art.

BRIEF DESCRIPTION OF THE DRAWINGS

The features and advantages of the invention will be more readily understood upon consideration of the following detailed description of the invention, taken in conjunction with the accompanying drawings in which.

DETAILED DESCRIPTION OF THE INVENTION

Figure 1A:
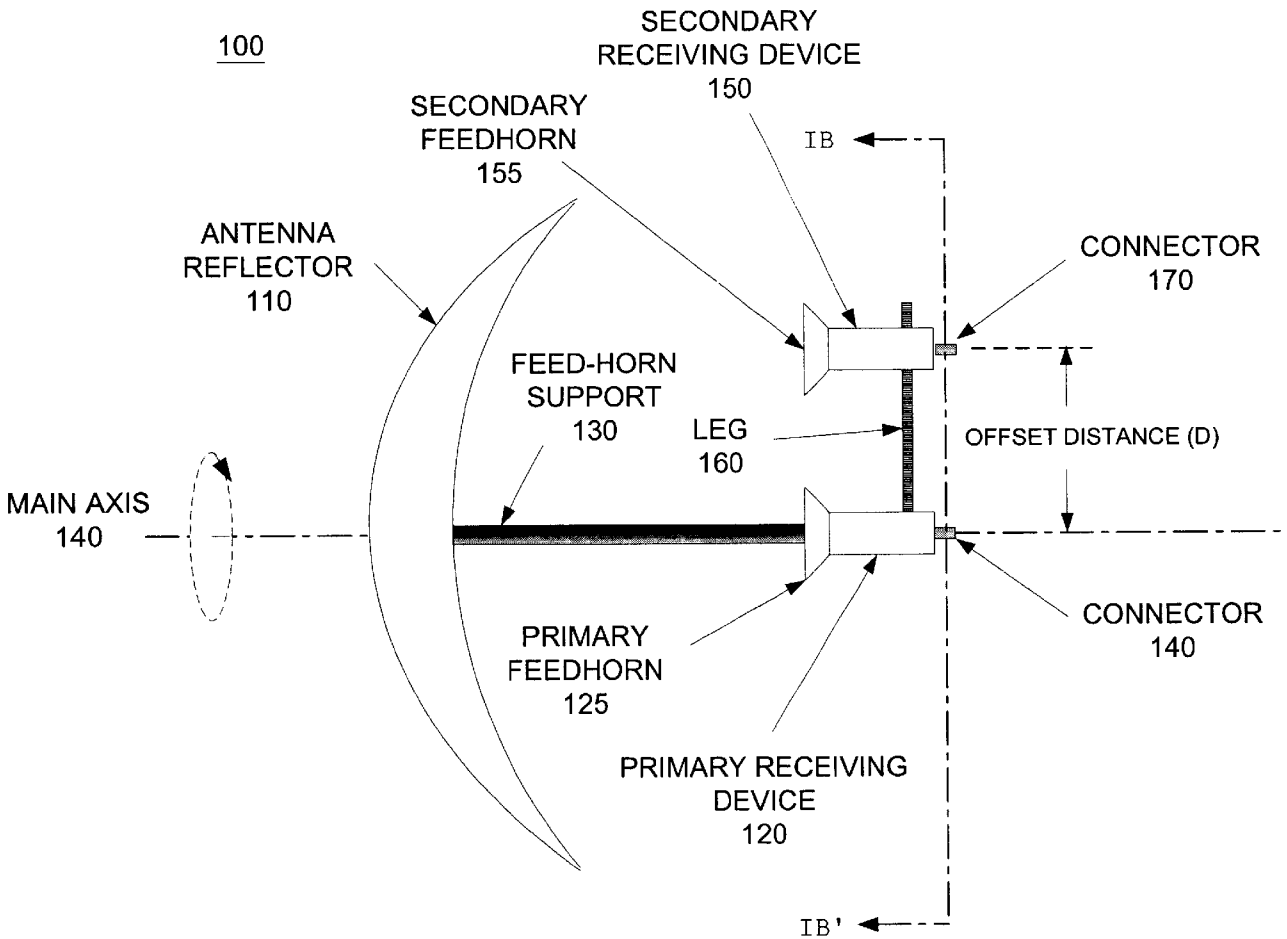
FIG. 1A depicts a plan view of an embodiment of the satellite antenna pointing apparatus of the present invention, FIG. 1B provides an elevation view in cross-section along section line IB–IB' of FIG. 1A.
Figure 1B:
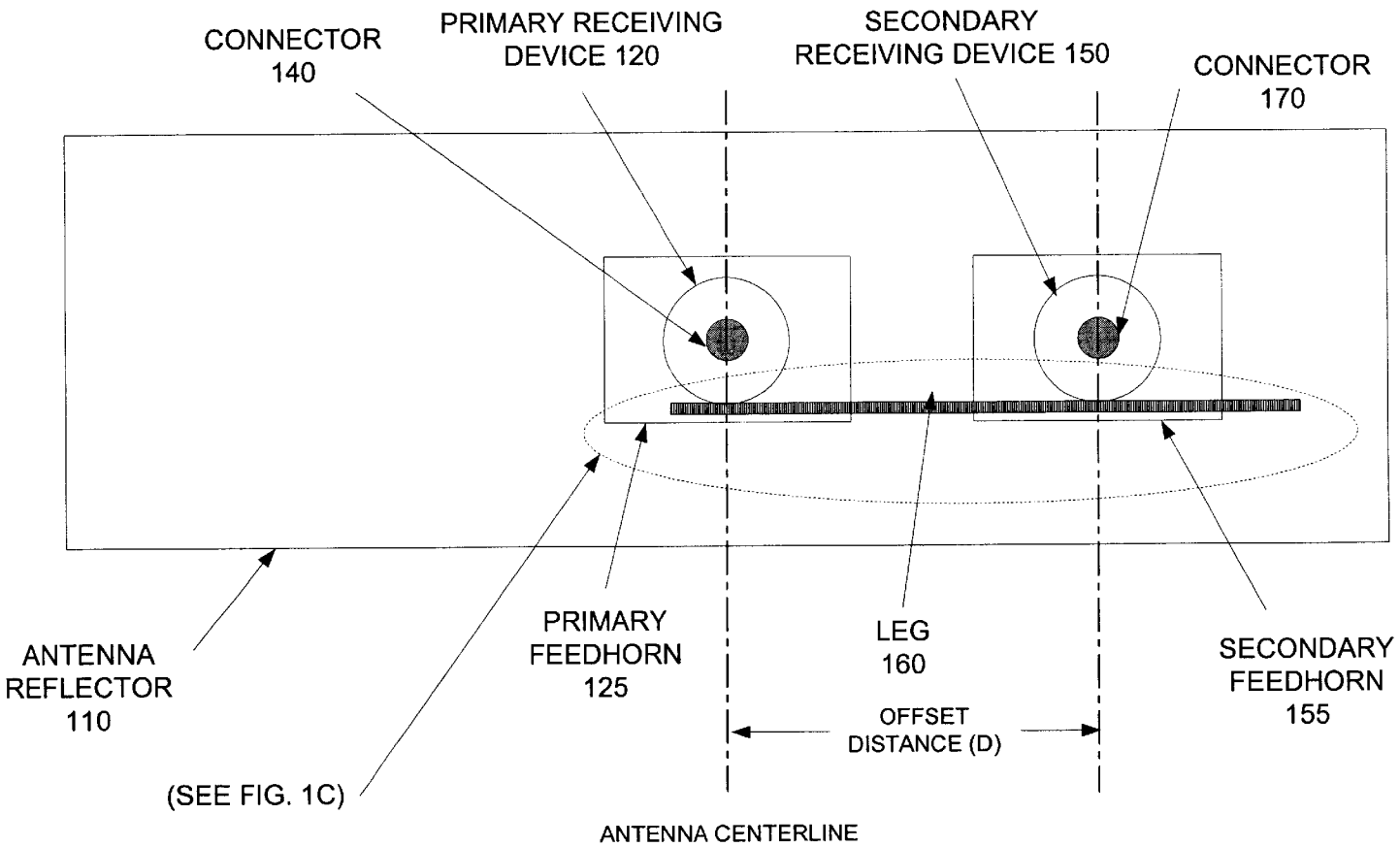
FIG. 1C provides a detailed view of the leg attachment to the primary and secondary receiving devices.
FIG. 1D provides a view in cross-section along section line ID–ID' of FIG. 1C.

A preferred embodiment of the apparatus of the present invention is described below. Turning to FIGS. 1A and 1B, satellite antenna pointing apparatus 100 is depicted. Satellite antenna pointing apparatus 100 preferably includes secondary receiving device 150 and secondary feedhorn 155 separated by leg 160 from primary receiving device 120 at an offset distance "D". This offset distance preferably corresponds to a secondary focal point, which is off main axis 140, the boresight of the antenna. Secondary receiving device 150, secondary feedhorn 155, and leg 160 may be separate "add-on" components temporarily configured to align the antenna to a desired satellite, or may be a permanent part of the installation, so that different signals or services from two different satellites separated in azimuth may simultaneously be received.

Primary receiving device 120 is preferably arranged at a primary focal point of antenna reflector 110, and also preferably includes primary feedhorn 125 supported by one end of feedhorn support 130, which is attached at an opposite end to antenna reflector 110 on main axis 140 of antenna reflector 110. Antenna reflector 110 preferably is parabolic in shape, to collect RF energy from a far-away source, for example, a satellite. Primary feedhorn 125 also may direct the collected RF energy into primary receiving device 120 for processing. FIG. 1B provides a cross-sectional view of the antenna, including the satellite antenna pointing apparatus, taken through section line IB–IB' shown in FIG. 1A.

Figure 1C:
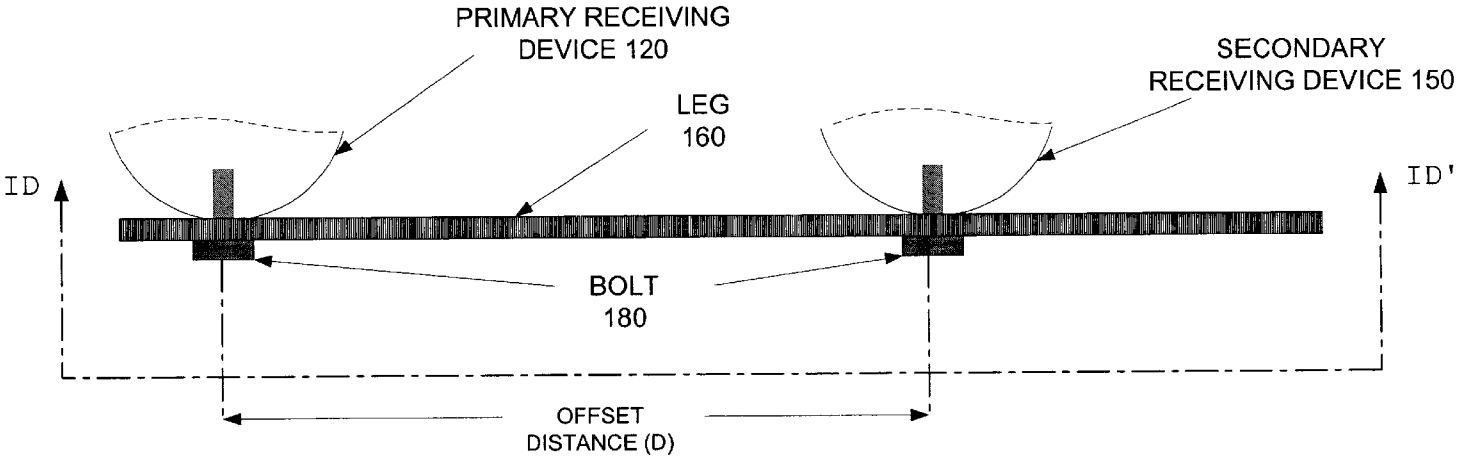
Figure 1D:
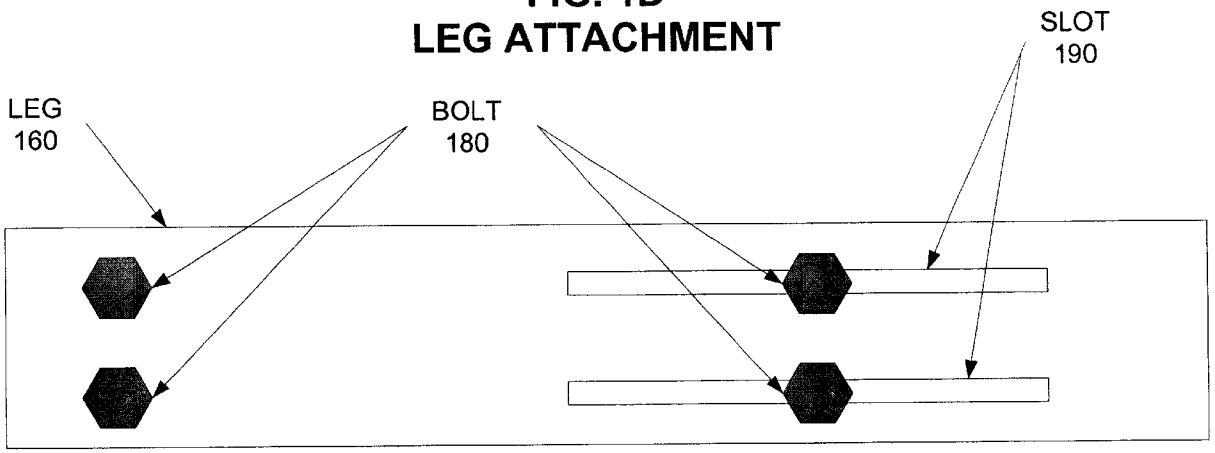

FIG. 1C provides an exemplary embodiment of the leg attachment arrangement, using bolts 180 to attach leg 160 to primary receiving device 120 and secondary receiving device 150. In a further preferred embodiment as shown in FIG. 1D, slots 190 are used in conjunction with bolt 180 to provide a means to adjust the position of secondary receiving device 150 relative to primary receiving device 120, i.e., offset-distance (D) can be varied, preferably to a position which corresponds to an offset-scan angle of the antenna which aligns with a satellite adjacent to the primary satellite. Although bolts and slots are depicted, any other means for attaching receiving devices 120 and 150 to leg 160, and for allowing adjustment of the offset-distance (D) may be used, e.g. a clamping arrangement (not shown).

Primary receiving device 120 may also include components and associated circuitry for transmitting an RF signal through feedhorn 125, which is then collimated and reflected by reflector 110 in a relatively narrow beam to a satellite, for example, or to another desired location.

Figure 2:
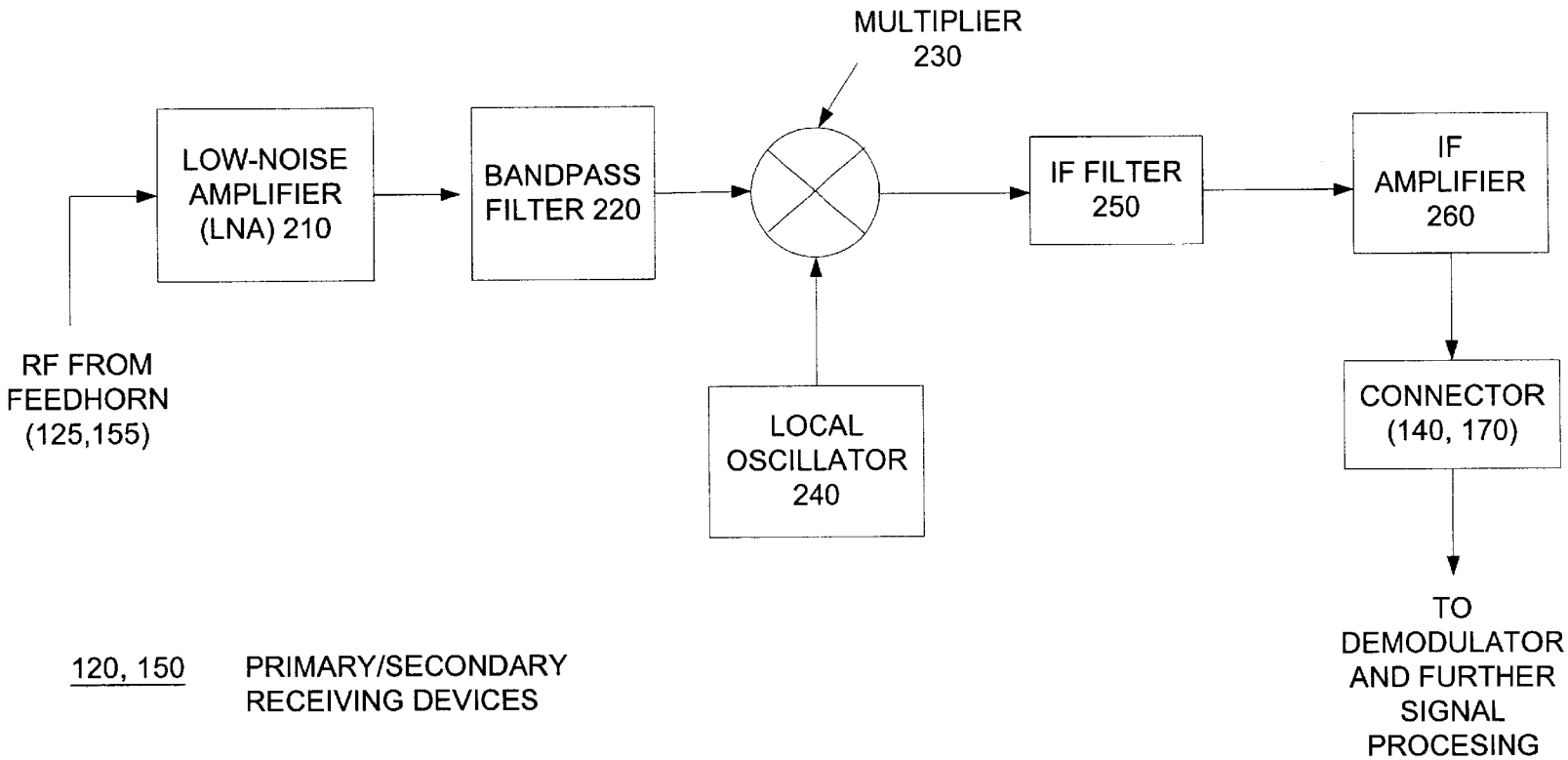
FIG. 2 provides a representative receiving device block diagram.

A receiving device representative of a type that may be used both for primary and secondary receiving devices 120 and 150, is depicted in FIG. 2. Primary and secondary receiving devices may each include, for example, low-noise amplifier (LNA) 210 receiving RF energy from feedhorn 125 or 155 and providing an amplified signal to bandpass filter 220. The band-limited signal from bandpass filter 220 is provided as one input to multiplier 230, which has local oscillator 240 as a second input. A down-converted signal at an intermediate frequency (IF) is output from multiplier 230, and may be further band-limited by IF filter 250, and amplified by IF amplifier 260. This amplified IF signal may be provided through connector 140 or 170 to other circuitry (not shown), for further processing of the received signals. Such further processing after initial processing in what may be described above as a "low-noise block" (LNB), may include, for example, demodulation or other baseband signal analysis.

As a further example, the primary receiving device may include a switch such as a waveguide switch (not shown), to allow the received signal to be routed to one of two receivers which preferably include what is known in the industry as a "low-noise block" (LNB), depending on which of two polarizations are desired to be received, e.g. or vertical or horizontal linear polarization. A LNB essentially includes the abovementioned circuitry, including a LNA, and the down conversion/band-limiting circuitry discussed above.

Intermediate frequency signals are preferably provided through connectors 140 and 170 by coaxial cables (not shown) to the other receiver circuitry, for example. Further, connectors 140 and 170 may also be used to provide test point access for evaluating the received signal strengths of primary receiving device 120 or secondary receiving device 150 using, for example, a hand-held or portable meter to measure the average power of the IF signal output of either of the receiving devices 120 or 150, as an indication of the received signal strength. Such a signal access point may be useful to the installing technician in determining the proper antenna alignment in azimuth and elevation, for example.

Figure 3:
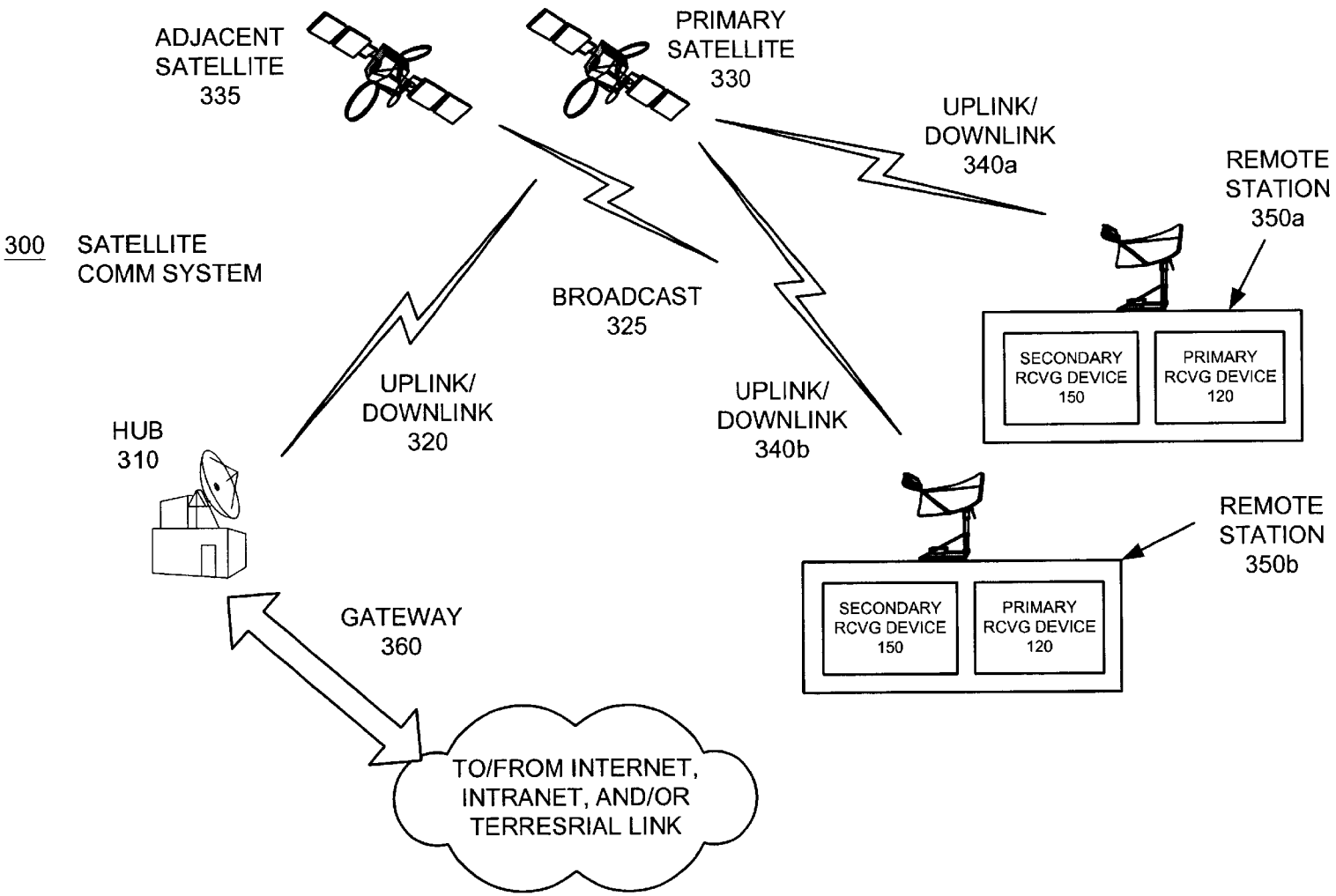
FIG. 3 provides a representation of a satellite communication system in which the apparatus and method of the present invention may be applied.
Figure 4:
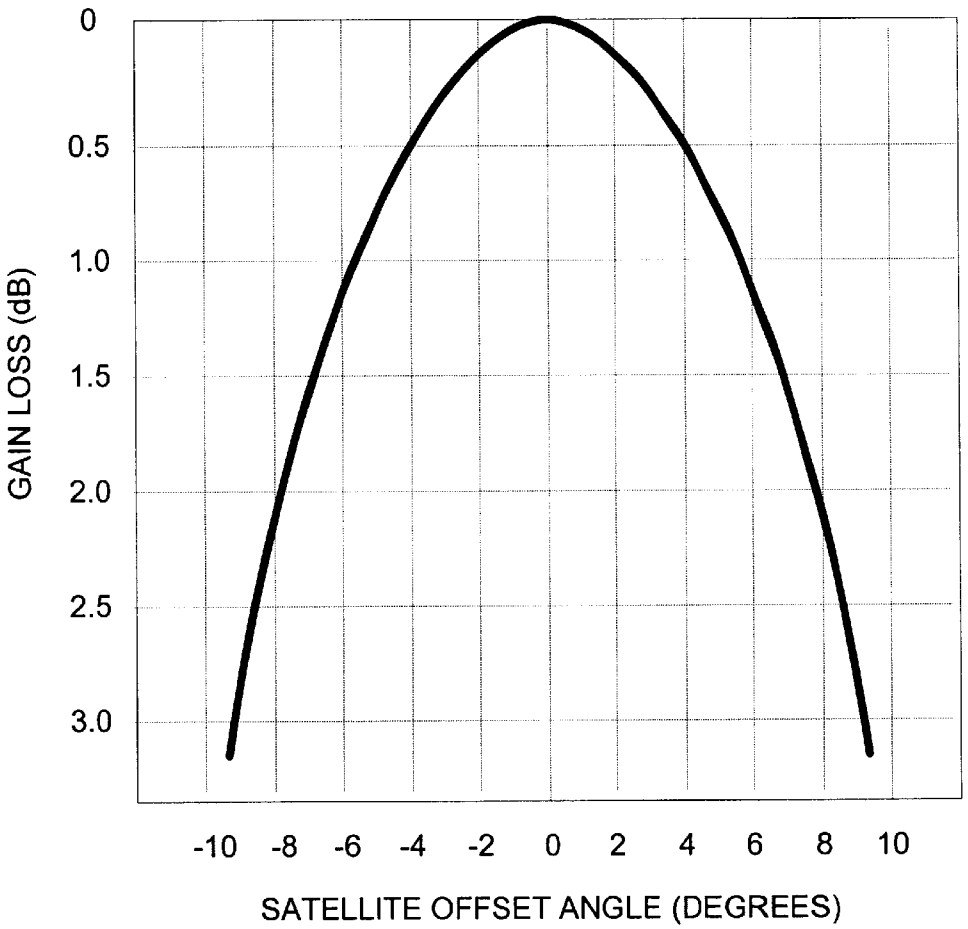
FIG. 4 provides a representative graph of offset-feed gain versus boresight angle of the apparatus of the present invention.

Referring to FIG. 3, typical satellite communication system 300, which may employ the apparatus and method of the present invention, is shown. Hub station 310 ("hub"), which may also be called a network operations center, transmits an uplink portion of uplink/downlink 320 to primary satellite 330. Through a transponder arrangement previously discussed (not shown), primary satellite 330 retransmits a downlink portion of downlinks 340*a* and 340*b* to remote stations 350*a* and 350*b*. Each of remote stations 350*a* and 350*b* may include primary and secondary receiving devices 120 and 150 to receive the signals from primary satellite 330 and adjacent satellite 335, respectively. Remote stations 350*a* and 350*b* may also transmit to primary satellite via an uplink portion of uplink/downlink 340*a* and 340*b*, which may then be retransmitted by a transponder on satellite 330 as a downlink portion of uplink/downlink 320 to hub 310.

Adjacent satellite 335 may transmit a set of signals on broadcast 325, for example. Secondary receiving devices 150 in each of remote stations 350*a* and 350*b* are preferably arranged to receive broadcast 325. Finally, Hub 310 may also provide access to/from the internet, an intranet, and/or a terrestrial link, e.g. a telephone line, via gateway 360.

When a feedhorn of a parabolic antenna is displaced at offset distance D or at an angle from the main focal point, the main beam radiation pattern moves in the opposite direction, at nearly the same angle. A scanned beam shows a decrease in antenna gain $\Delta G$, as notionally depicted in FIG. 3. Sidelobes in the direction of the scan are suppressed, and the trailing sidelobes increase. The term "coma lobe" is sometimes used to describe the largest trailing sidelobe.

Practically speaking, the scanning process can continue until the gain loss and coma lobe interference produce objectionable results. However, other higher order aberrations, such as astigmatism, filling in of pattern nulls, and beam broadening, are associated with large scan angles, and are preferably avoided. For 2-degree spaced satellites, for example, scan angles can be confined to a narrow ±8-degree or less range. Over this range the decrease is gain may be approximated by:

$\Delta G = -0.045 \times (2\Phi)$, where "$\Phi$" is the scan angle off the boresight.

Generally, speaking, the maximum off-axis scan available is a function of the antenna dish size and the antenna focal length and/or distance of a LNB from the antenna surface. Off-axis scan angles of between 20–30 degrees may be achievable under some circumstances, depending on the antenna configuration.

Figure 5:
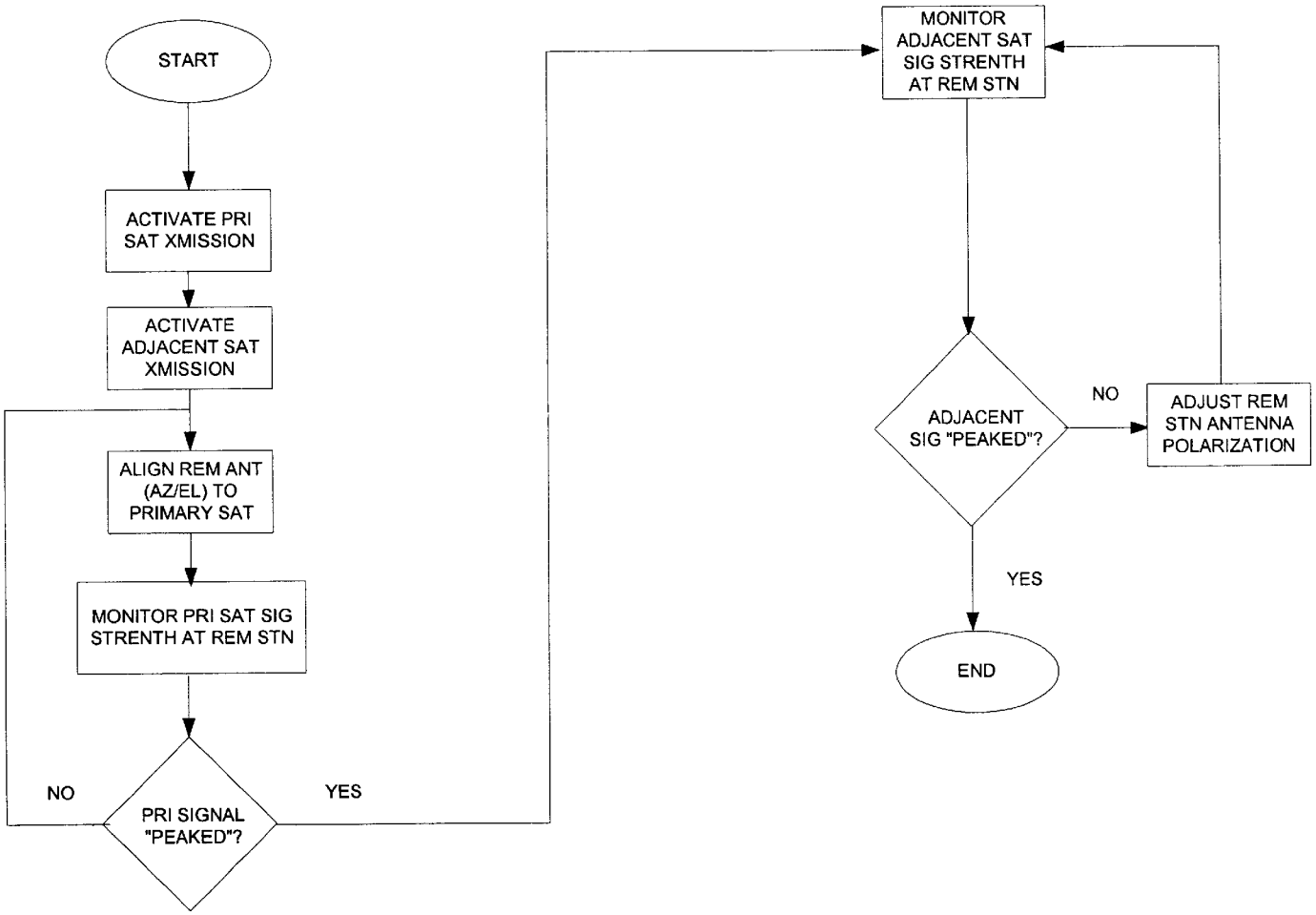
FIG. 5 provides a representative flow-chart depicting the improved satellite antenna alignment process using the apparatus and method of the present invention.
Figure 6:
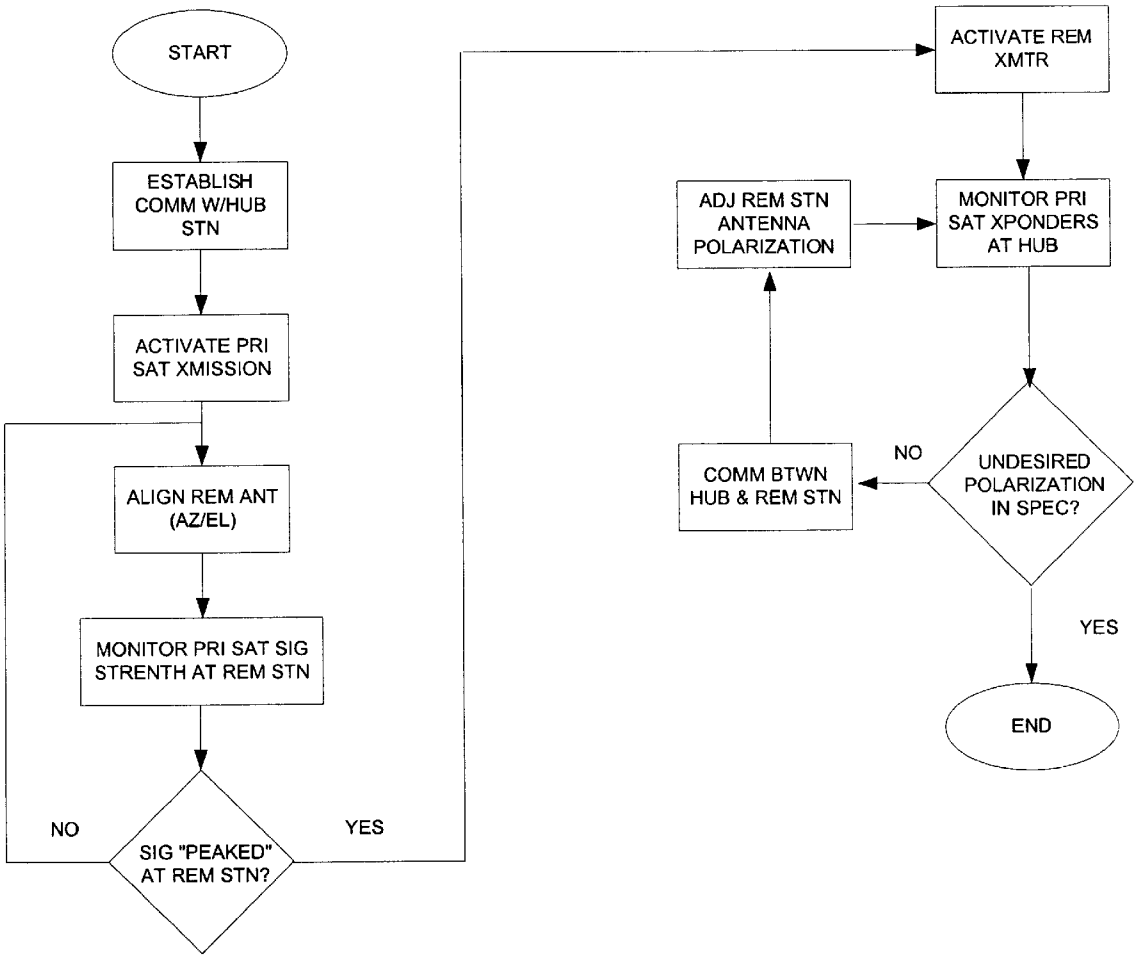
FIG. 6 provides a representative flow-chart depicting a conventional satellite antenna alignment process.

Turning now to FIG. 5, the improved satellite antenna alignment process using the above-described apparatus will now be described. First, primary satellite is preferably "active", i.e., transmitting a downlink portion in uplink/downlink 340*a*, which may be received by primary receiving device 120 in remote station 350*a*, for example. In addition, adjacent satellite 335 is also preferably activated to transmit a signal that may be received by secondary receiving device 150, e.g., broadcast 325. The person installing or adjusting the antenna of remote station 350*a* preferably aligns the antenna in azimuth and elevation by iteratively adjusting these angles based on a signal strength of a primary signal received by primary receiving device 120. A hand-held IF power meter connected to primary receiving device 120 through connector 140, for example may be used to measure this signal strength.

Once the primary signal is "peaked", or essentially maximized, by iteratively adjusting the azimuth and elevation angles of the antenna, a secondary signal, e.g. broadcast 325, is preferably monitored by the installer using, for example, a hand-held IF power meter connected to secondary receiving device 150 through connector 170 may be used to measure this signal strength. While keeping the azimuth and elevation angles of the main antenna axis, or boresight, fixed in their orientation, the installer preferably rotates the entire antenna reflector 110 about the boresight (as indicated by the dashed line shown around main axis 140 in FIG. 1A). Secondary receiving device 150 then moves in a prescribed arc about the boresight when antenna reflector 110 is rotated in such a manner. By either pre-setting offset-distance (D), or adjusting offset-distance (D) in the field during installation to a particular distance, the secondary receiving device can be made to align, through the offset-scan angle of the antenna, with a different satellite adjacent to the primary satellite. Because of the allocation of orbital slots in the so-called "Clarke Belt" where geo-synchronous satellites orbit, there is only one offset-distance (D) which will allow the boresight to be aligned with the primary satellite, while aligning the secondary receiving device, through the offset-scan angle of the antenna, with a satellite adjacent to the primary satellite, at a different longitudinal angle.

For example, if the primary satellite is geo-synchronously located at 91 degrees west longitude, and the adjacent or secondary satellite is located at 101 degrees west longitude (a 10 degree orbital offset), there is only one offset-distance (D) which will allow both of these satellites to be received by remote station 350, and there is only one orientation of antenna reflector 110 which will ensure that the proper polarization alignment of the remote station antenna is achieved.

Although discussion of a preferred embodiment of the present invention has been directed to a satellite communication system, the method and system of the present invention is not limited to such an implementation. For example, the present invention may also be applicable to other communication links, for example, a terrestrial point-to-point microwave communication could also benefit from the alignment features and techniques provided by the present invention.

It will be obvious that the present invention may be varied in many ways. Such variations are not to be regarded as a departure from the spirit and scope of the invention, and all such modifications as would be obvious to one skilled in the art are intended to be included within the scope of the following claims. The breadth and scope of the present invention is therefore limited only by the scope of the appended claims and their equivalents.

What is claimed is:

1. An apparatus for aligning an antenna, comprising:

a secondary receiving device arranged on the antenna and separated from a primary receiving device of the antenna, wherein the primary receiving device receives a first signal of a first polarization and the secondary receiving device receives a second signal of a second polarization different from the first polarization, and wherein alignment of the antenna is made by pointing the secondary receiving device in a direction of the second signal for proper polarization alignment.

2. The apparatus of claim 1, wherein the primary receiving device is located along a main axis of the antenna, and the secondary receiving device is in an offset position with respect to the main axis.

3. The apparatus of claim 2, wherein the offset position is set to correspond to an orbital position of an adjacent satellite with respect to a desired satellite.

4. The apparatus of claim 2, wherein alignment of the antenna includes a polarization alignment made by rotating the secondary receiving device about the main axis of the antenna.

5. The apparatus of claim 1, wherein alignment of the antenna includes setting an azimuth angle and an elevation angle of a boresight of the antenna, and setting a polarization angle by rotating the secondary receiving device about the boresight.

6. The apparatus of claim 1, wherein the primary receiving device is mounted on a feed arm of the antenna, and the secondary receiving device is located on a leg extending from the feed arm.

7. The apparatus of claim 6, wherein a position of the secondary receiving device on the leg determines an offset antenna scan angle.

8. The apparatus of claim 1, wherein the signal received by the first receiving device is adjusted by orienting an antenna azimuth and an antenna elevation, and the signal received by the second receiving device is adjusted by setting an antenna orbital arc angle.

9. The apparatus of claim 1, wherein the primary receiving device is mounted at a primary focal point of the antenna corresponding to a desired satellite, and the secondary receiving device is located at a focal point corresponding to an adjacent satellite.

10. The apparatus of claim 9, wherein the primary focal point of the antenna is different that the focal point corresponding to the adjacent satellite.

11. The apparatus of claim 1, wherein the first polarization is a linear polarization, and the second polarization is one of another linear polarization and a circular polarization.

12. A method of aligning an antenna, comprising:

monitoring a received signal strength of a primary signal having a first polarization;

adjusting a position of the antenna based on the received signal strength of the primary signal;

monitoring a received signal strength of a secondary signal having a second polarization different from the first polarization; and further adjusting the antenna based on the received signal strength of the secondary signal for proper polarization alignment.

13. The method of claim 12, further comprising:

adjusting an elevation angle and an azimuth angle of a boresight of the antenna; and adjusting a polarization orientation includes rotating the antenna about a boresight of the antenna.

14. The method of claim 12, further comprising setting a position of a receiving device off a main axis of the antenna.

15. The method of claim 14, wherein the set position corresponds to an offset scan angle of the antenna.

16. The method of claim 15, wherein the offset scan angle corresponds to an orbital position of a satellite adjacent to a primary satellite.

17. The method of claim 12, wherein said step of adjusting a position of the antenna is accomplished by essentially maximizing the received signal strength of the primary signal.

18. The method of claim 12, wherein said step of further adjusting a position of the antenna is accomplished by essentially maximizing the received signal strength of the secondary signal.

19. The method of claim 12, wherein said first polarization is a linear polarization, and the second polarization is one of another linear polarization and a circular polarization.

20. The apparatus of claim 1, wherein the secondary receiving device is temporarily arranged on the antenna.

21. The method of claim 12, further comprising:

temporarily attaching a receiving device onto the antenna for receiving the secondary signal.

22. A method of installing a multiple beam antenna, the method comprising:

adjusting position of the antenna to peak signal strength of a first signal with a first polarization; and rotating the antenna about a boresight of the antenna to peak signal strength of a second signal having a second polarization that is different from the first polarization, whereby proper polarization alignment is achieved for the respective signals.

23. The method of claim 22, further comprising:

temporarily attaching a receiving device onto the antenna for receiving the second signal.

24. The method of claim 22, wherein the first polarization is a linear polarization, and the second polarization is one of another linear polarization and a circular polarization.

25. The method of claim 22, wherein the first signal and the second signal emanate, respectively, from a primary satellite and an secondary satellite that is adjacent to the primary satellite.

* * * * *